United States Patent [19]

Watanabe

[11] Patent Number: 5,020,488

[45] Date of Patent: Jun. 4, 1991

[54] VALVE MECHANISM FOR AN INTERNAL COMBUSTION ENGINE

[75] Inventor: Kenzo Watanabe, Tokyo, Japan

[73] Assignee: Fuji Jukogyo Kabushiki Kaisha, Tokyo, Japan

[21] Appl. No.: 596,770

[22] Filed: Oct. 12, 1990

[30] Foreign Application Priority Data

Nov. 22, 1989 [JP] Japan ..... 1-306077
Nov. 22, 1989 [JP] Japan ..... 1-306078

[51] Int. Cl.[5] ..... F01L 1/34; F01L 1/18

[52] U.S. Cl. ..... 123/90.16; 123/90.17; 123/90.44; 74/519; 74/559

[58] Field of Search ..... 123/90.15, 90.16, 90.17, 123/90.22, 90.27, 90.39, 90.4, 90.41, 90.44, 90.47; 74/519, 559

[56] References Cited

U.S. PATENT DOCUMENTS

| | | | |
|---|---|---|---|
| 3,882,832 | 5/1975 | Ohsaki et al. | 123/90.17 |
| 4,572,118 | 2/1986 | Baguéna | 123/90.16 |
| 4,768,467 | 9/1988 | Yamada et al. | 123/90.16 |
| 4,768,475 | 9/1988 | Ikemura | 123/90.17 |
| 4,794,893 | 1/1989 | Masuda et al. | 123/90.17 |
| 4,854,273 | 8/1989 | Uesugi et al. | 123/90.16 |
| 4,886,022 | 12/1989 | Nakai | 123/90.17 |

FOREIGN PATENT DOCUMENTS

| | | | |
|---|---|---|---|
| 62-32206 | 2/1987 | Japan . | |
| 0096406 | 4/1989 | Japan | 123/90.44 |
| 0208505 | 8/1989 | Japan | 123/90.17 |

*Primary Examiner*—David A. Okonsky
*Assistant Examiner*—Weilun Lo
*Attorney, Agent, or Firm*—Martin A. Farber

[57] ABSTRACT

A valve mechanism has a low-speed cam and a high-speed cam, a low-speed rocker arm operatively connected a valve and a high-speed rocker arm. A change-over device is provided for connecting the low-speed and high-speed rocker arm with each other so as to be rocked together by the high-speed cam. A roller follower is rotatably mounted on a shaft provided in the low-speed rocker arm. The high-speed rocker arm has a slipper engaging with the high-speed cam. The change-over device has a piston slidably mounted in the high-speed rocker arm so as to connect the high-speed rocker arm with the low-speed rocker arm.

4 Claims, 10 Drawing Sheets

VALVE MECHANISM FOR AN INTERNAL COMBUSTION ENGINE

BACKGROUND OF THE INVENTION

The present invention relates to a valve mechanism for an automotive engine and more particularly to a valve mechanism where the valve lift and valve timing of the valves are varied in accordance with engine speed.

In an automotive engine, the valve timings of the intake and exhaust valves have a large influence on volumetric efficiency of the engine, stability of low engine speed and high engine speed performance. Namely, if the valve overlap period wherein the intake valves and the exhaust valves are both opened before and after the top dead centers becomes long, the quantity of induced air increases in a high engine speed range because of the inertia of the intake and exhaust air. Thus, the volumetric efficiency is improved, and hence the power of the engine is increased. However, in a low engine speed range, such a long valve overlap period may cause the intake air to flow back or to escape to the exhaust port so that the engine speed becomes unstable. Thus, it is preferable to decrease the overlap period in the low engine speed range. Accordingly, it is required to properly control the valve timing in the entire engine speed range to ensure the stability of engine speed and high engine performance under any engine operating conditions.

In order to change the valve timing, there has been proposed a valve mechanism where a low-speed cam for a low engine speed range, a high-speed cam for a high engine speed range and rocker arms corresponding to the respective cams are provided. One of the rocker arms is operatively connected to the valve and both rocker arms are connected or disconnected with each other in accordance with the engine speed so as to select a necessary cam. Hence the valves are operated to open at a small lift and a small opening degree at a low engine speed and to open at a large lift and a large opening degree at a high engine speed.

Japanese Patent Application Laid-Open 62-32206 discloses such a valve mechanism where the rocker arms are mechanically connected. One of the rocker arms, which are mounted on a rocker arm shaft, is operatively connected to the valve. A slipper is provided between the rocker arms and engages with the low-speed cam and the high-speed cam. A changeover device having a piston and urged by a spring is provided so that the rocker arms are connected or disconnected with each other by hydraulically operating the piston.

In the system, both of the high-speed cam and the low-speed cam are engaged with the corresponding rocker arms through the slipper. Since a film of oil is not sufficiently formed between the slipper and the cams in the low engine speed range, torque for driving the rocker arm becomes extremely large as shown in FIG. 9. As a result, the fuel consumption increases. In addition, the construction of the connecting device becomes complicated because the connecting device is provided in the rocker arms. Furthermore, a shearing force is exerted on the piston when the connected rocker arms swing, which will decrease the durability of the piston.

Thus, it is preferable to employ a roller follower instead of the slipper to decrease the friction between the low-speed cam and the rocker arm, and hence to decrease the driving torque. However, since the periphery of the roller follower is located higher than the slipper, the cam shaft must be located at a higher position, which results to increase the space for the valve mechanism. Alternatively, the roller follower may be disposed in a groove formed in the rocker arm so as to reduce the hight of the roller from the rocker arm. In such a case, design of the construction and the arrangement of the changeover device must be difficult. Thus, if the roller follower is used, it is necessary to improve the changeover device.

SUMMARY OF THE INVENTION

The object of the present invention is to provide a compact changeover device of a valve mechanism for changing the valve lift and the valve timing of the valves so that a roller follower can be disposed between the cam and the rocker arm of the valve mechanism, thereby decreasing the driving torque thereof in a low engine speed range without increasing the height of the cam shaft.

According to the present invention there is provided a valve mechanism for an internal combustion engine having at least one intake valve and at least one exhaust valve, a cam shaft having a low-speed cam and a high-speed cam, a low-speed rocker arm operatively connected one of the valves and a high-speed rocker arm which are rocked by the cams to operate the valve operatively connected one of the valves, changeover means for connecting the low-speed rocker arm and high-speed rocker arm with each other so as to be rocked together by the high-speed cam. The mechanism comprises the low-speed cam having a base circle the diameter of which is larger than that of a base circle of the high-speed cam, a roller follower rotatably mounted on a shaft provided in the low-speed rocker arm, a part of a peripheral portion of the roller follower being projected from the rocker arm to be engaged with the low-speed cam, the high-speed rocker arm having a slipper engaging with the high-speed cam, the changeover means comprising a piston slidably mounted in the high-speed rocker arm and means for pushing the piston so as to connect the high-speed rocker arm with the low-speed rocker arm.

In an aspect of the invention, the piston is disposed perpendicular to the axis of the shaft for the rocker follower.

In another aspect of the invention, two sets of low-speed cams and low-speed rocker arms are provided for operating two valves respectively, the high-speed rocker arm is disposed between the low-speed rocker arms, the piston of the changeover means is so provided as to engage with the shaft for two roller followers.

The other objects and features of this invention will become understood from the following description with reference to the accompanying drawings.

DETAILED DESCRIPTION OF THE PREFERRED EMBODIMENTS

Figure 1:
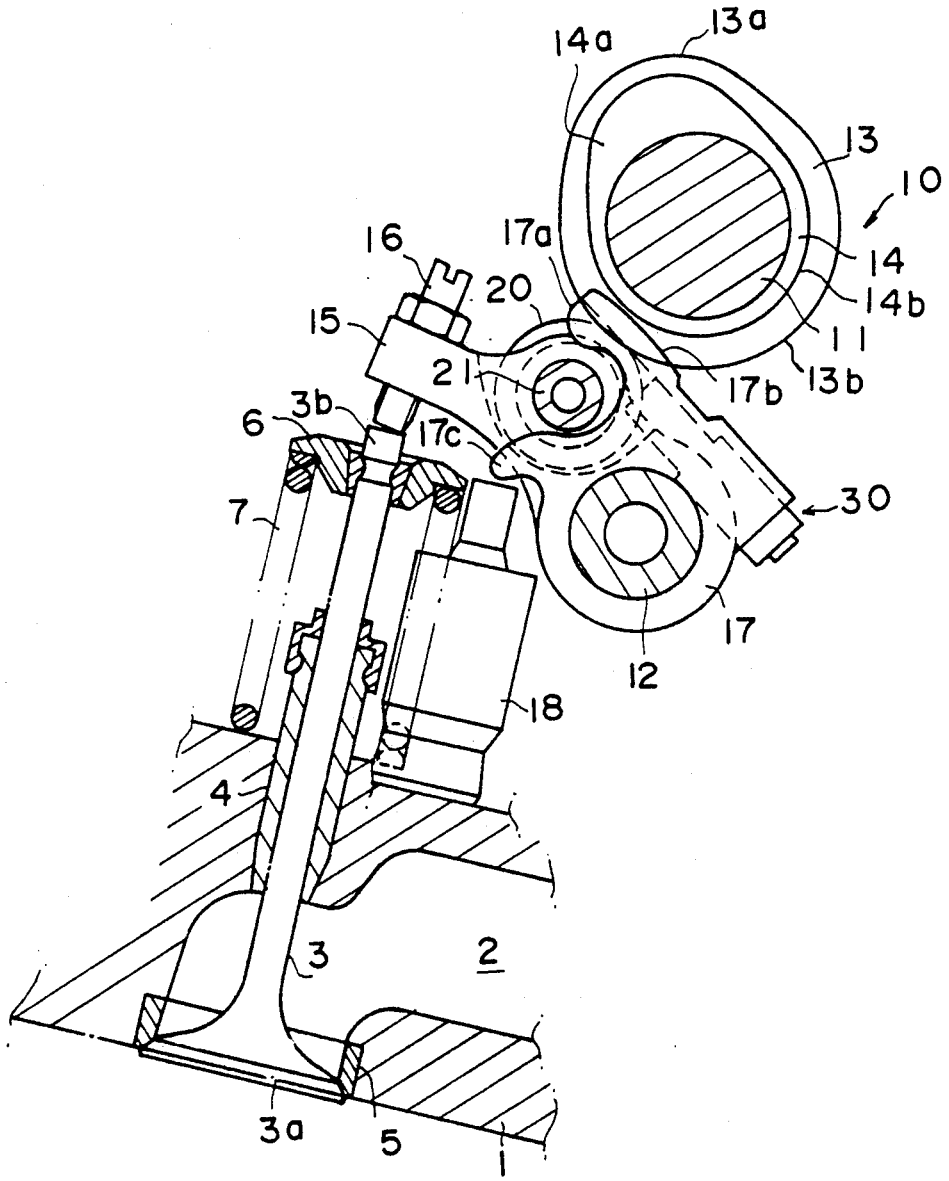
FIG. 1 is a sectional view of a valve mechanism according to the present invention.
Figure 2:
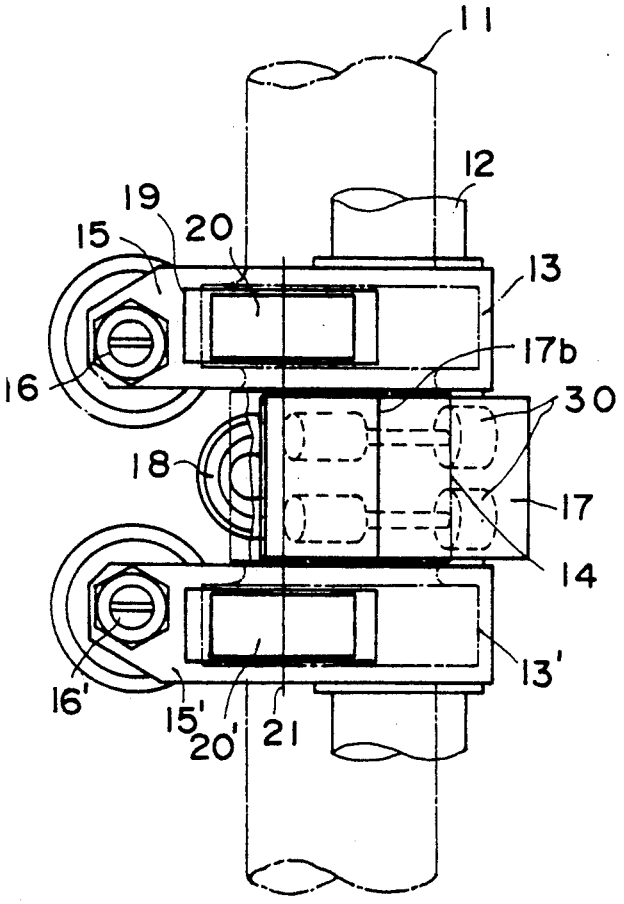
FIG. 2 is a plan view of the valve mechanism.
Figure 3:
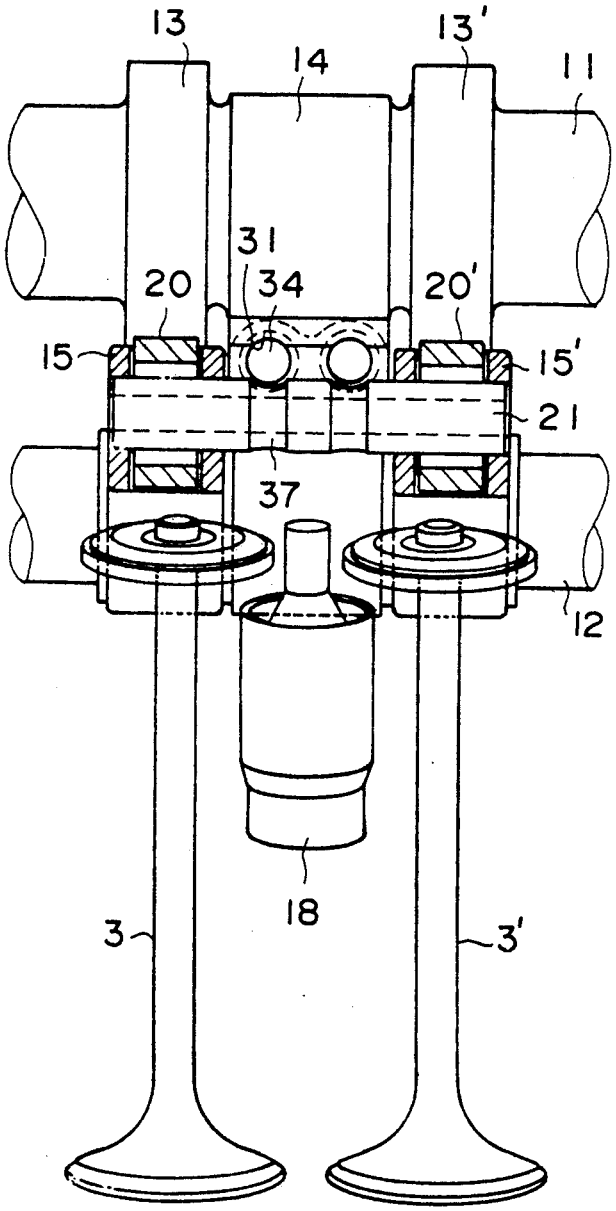
FIG. 3 is a partially cutaway elevational view of the valve mechanism.

Referring to FIGS. 1 to 4, an engine to which the present invention is applied comprises a cylinder head 1 having a bifurcated intake port 2, a pair of intake valves 3, 3' each of which is slidably mounted in the cylinder head 1 through a valve guide 4. Each valve has a valve head 3*a* engaging with a valve seat 5 of the intake port 2 and a stem end 3*b* having a retainer 6. A valve spring 7 is provided between the retainer 6 and the cylinder head 1 to urge each of valves 3, 3' to the valve seat 5.

A valve mechanism 10 for the intake valves 3, 3' comprises a camshaft 11 and a rocker arm shaft 12 which are parallel to the camshaft 11 and securely mounted on the cylinder head 1. The camshaft 11 is operatively connected to a crankshaft of the engine so as to be rotated at a speed one-half the crankshaft. On the camshaft 11 is formed a high-speed cam 14, and a pair of low-speed cams 13, 13' formed on opposite sides of the high-speed cam 14. The high-speed cam 14 is formed with a base circle 14*b* and a lobe 14*a* providing a predetermined large lift and a large opening angle for the valve in a high engine speed range. Each of the low-speed cams 13, 13' has a large base circle 13*b* and a large lobe 13*a* providing a predetermined small lift and a small opening angle of the valves in a low engine speed range.

Pivotally mounted on the rocker arm shaft 12 is a pair of inclined L-shaped low-speed rocker arms 15, 15' at the respective end thereof, corresponding to the low-speed cams 3, 13'. An inclined high-speed rocker arm 17 is pivotally mounted on the rocker arm shaft 12 between the low-speed rocker arms 15, 15', corresponding to the high-speed cam 14. The end of each low-speed rocker arm 15 (15') engages the stem end 3*b* of the valve 3 (3') through an adjusting screw 6 (16'). In each of the top surface of the rocker arms 15, 5', a deep groove 19 is formed. Roller followers 20 and 20' are rotatably mounted on a shaft 21 and disposed in respective grooves 19. The shaft 21 is provided through the rocker arms 15, 15' and secured thereto. A part of peripheral portion of each roller follower 20 (20') upwardly protrudes out of the groove 19 so as to abut against the corresponding low-speed cam 13 (13').

The high-speed rocker arm 17 has a U-shape so as not to interfere with the shaft 21. The high-speed rocker arm 17 has an upper free end 17*a* on which a slipper 17*b* is formed for bearing on the second cam 14. A lower free end 17*c* engages with spring means 18 so that the upper end 17*a* is constantly pressed against the high-speed cam 14.

A pair of changeover devices 30 are parallelly provided in the rocker arm 17.

Figure 4:
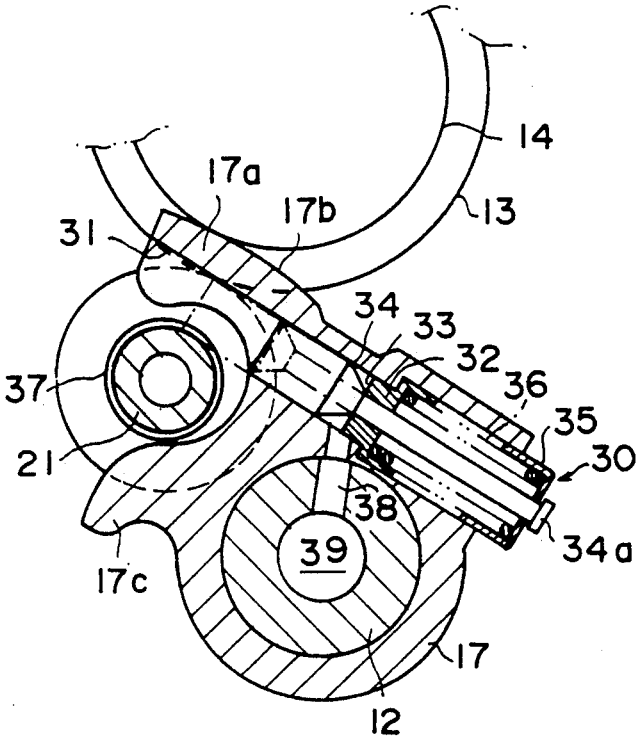
FIG. 4 is an enlarged sectional view of a changeover device of the present invention.

Referring to FIG. 4, each changeover device 30 has a bore 31 formed in an upper portion of the rocker arm 17, located above the shaft 21 perpendicular to the axis of the shaft. A piston 34 is slidably mounted in the bore 31. A partition 32 is provided in the bore 31 at the middle thereof to define an oil chamber 33 in the bore 31 together with the piston 34. The piston 34 has a rod 34*a* which extends through the bore 31 at the other side of the partition 32. A retainer 35 is secured at the end of the rod 34*a*. A spring 36 is disposed between the partition 32 and the piston 34 for urging the piston 34 to a retracted position. An annular groove 37 is formed on the periphery of the shaft 21 at a position opposing the piston 34. The oil chamber 33 is communicated with an oil gallery 39 formed in the rocker arm shaft 12 through a passage 38.

When the base circle of the high-speed cam 14 is in contact with the high-speed rocker arm 17, the space between the bottom of the groove 37 on the shaft 21 and the inside wall of the bore 31 in the high-speed rocker arm 17 becomes maximum. AT that time, oil is supplied to the oil chamber 33, the piston 34 is pushed toward the shaft 21 and inserted in the space between the groove 37 and the bore 31 at the upper end 17*a*. Thus, the rocker arm 17 and the shaft 21 and hence the rocker arms 15, 15' is combined with each other. While the rocker arms are thus connected, the roller followers 20 and 20' are disengaged from the low-speed cams 13 and 13' except the base circle.

Figure 5A:
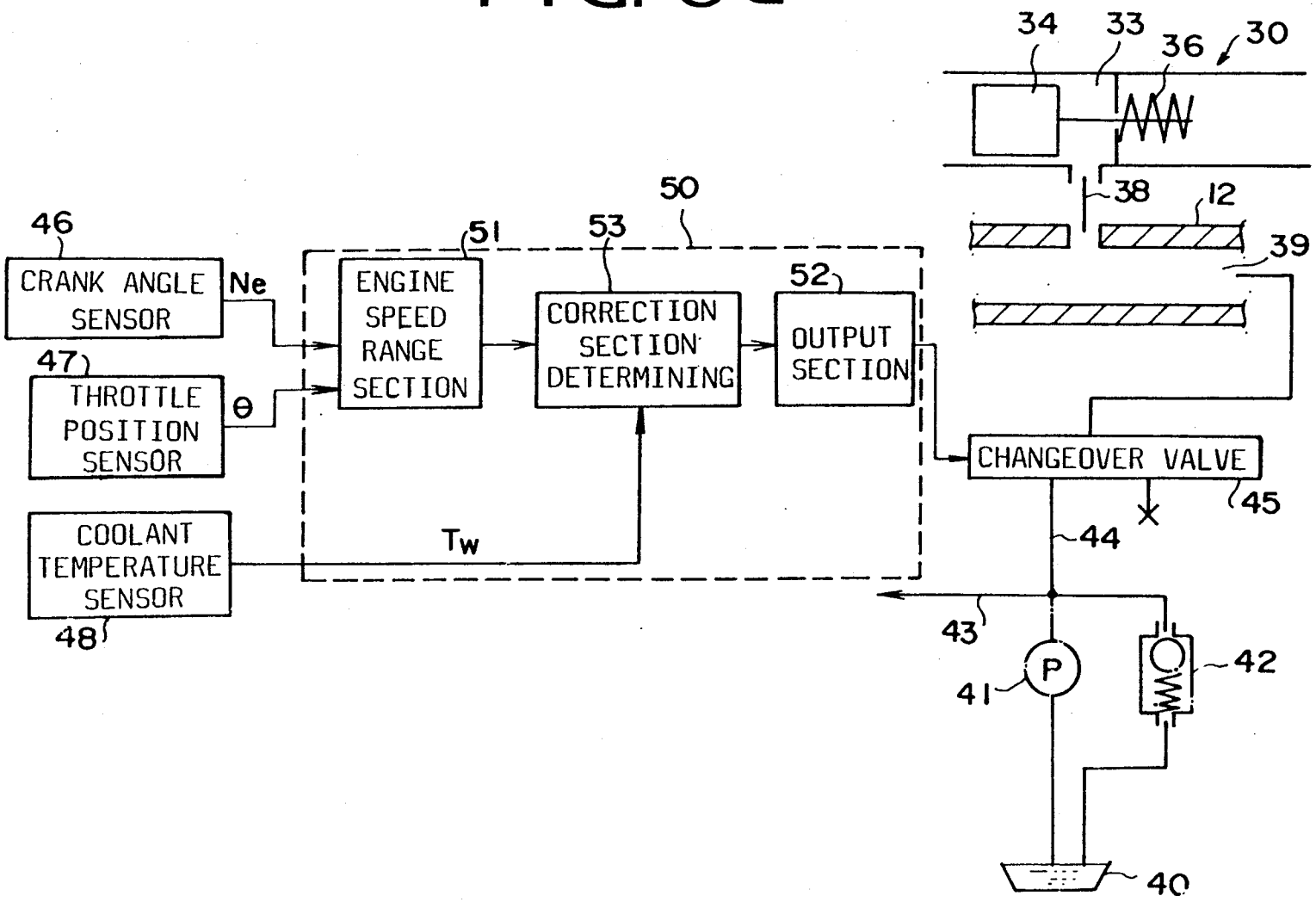
FIG. 5*a* is a schematic diagram of a control system of the present invention.

Referring to FIG. 5*a* showing a control system for the changeover device 30, the hydraulic control unit of the system comprises a pump 41 communicated with an oil pan 40 where lubricating oil is reserved, a relief valve 42 for regulating the pressure of the lubricating oil, passage 43 for supplying the oil to the parts to be lubricated, and a solenoid operated changeover valve 45 communicated with the pump 41 through a passage 44. The changeover valve 45 is further communicated with the oil gallery 39, which is communicated with the oil chamber 33 through the passage 38. The changeover valve 45 is operated by pulses from an electronic control unit 50.

Figure 5B:
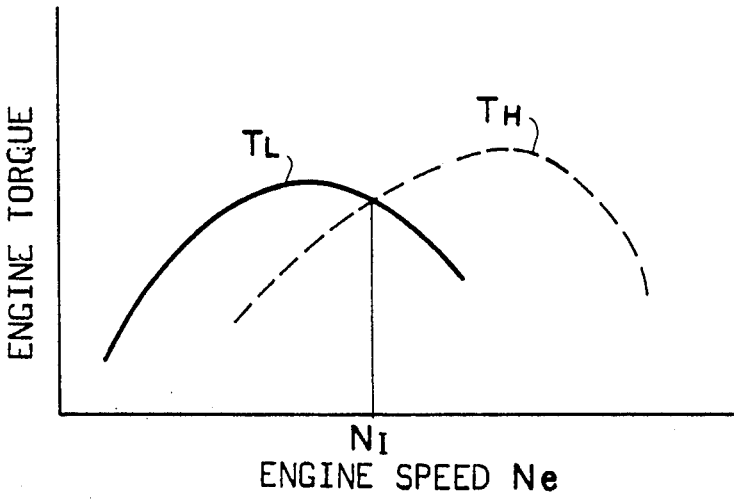
FIG. 5*b* is a graph showing relationships between the engine speed and engine torque.

The control unit 50 is supplied with an engine speed Ne from a crank angle sensor 46, a throttle opening degree $\theta$ from a throttle position sensor 47, and a coolant temperature Tw from a coolant temperature sensor 48. The control unit 50 has an engine speed range determining section 51 to which the engine speed Ne and throttle opening degree $\theta$ are applied. The engine speed range of the engine speed Ne is determined in accordance with a reference engine speed NI. As shown in FIG. 5*b*, the reference engine speed NI is set at engine speed at which a line TL showing the torque characteristic of the low-speed cams 13, 13' and a line TH showing the torque characteristic of the high-speed cam 14 intersect. The reference engine speed NI is corrected so as to broaden the high engine speed range at a light engine load determined by a small throttle opening degree, and to broaden the low engine speed range at a heavy engine load determined by a large throttle opening degree. Thus, whether the engine in a high engine speed range or in a low engine speed range is determined in dependency on the reference engine speed NI.

The output singal of the determining section 51 is fed to a correction section 53 to which the coolant temperature Tw from the coolant temperature sensor 48 is fed, so that, at the cold engine, the low engine speed range is selected irrespective of the engine speed Ne. An engine speed range signal from the correction section 53 is fed to the changeover valve 45 through an output section 52. When a low engine speed range is determined, the solenoid operated changeover valve 45 is operated to drain the oil chamber 33 of the changeover device 30. To the contrary, when a high engine speed range is determined, the changeover valve 45 is operated to supply the oil to the oil chamber 33.

Figure 6A:
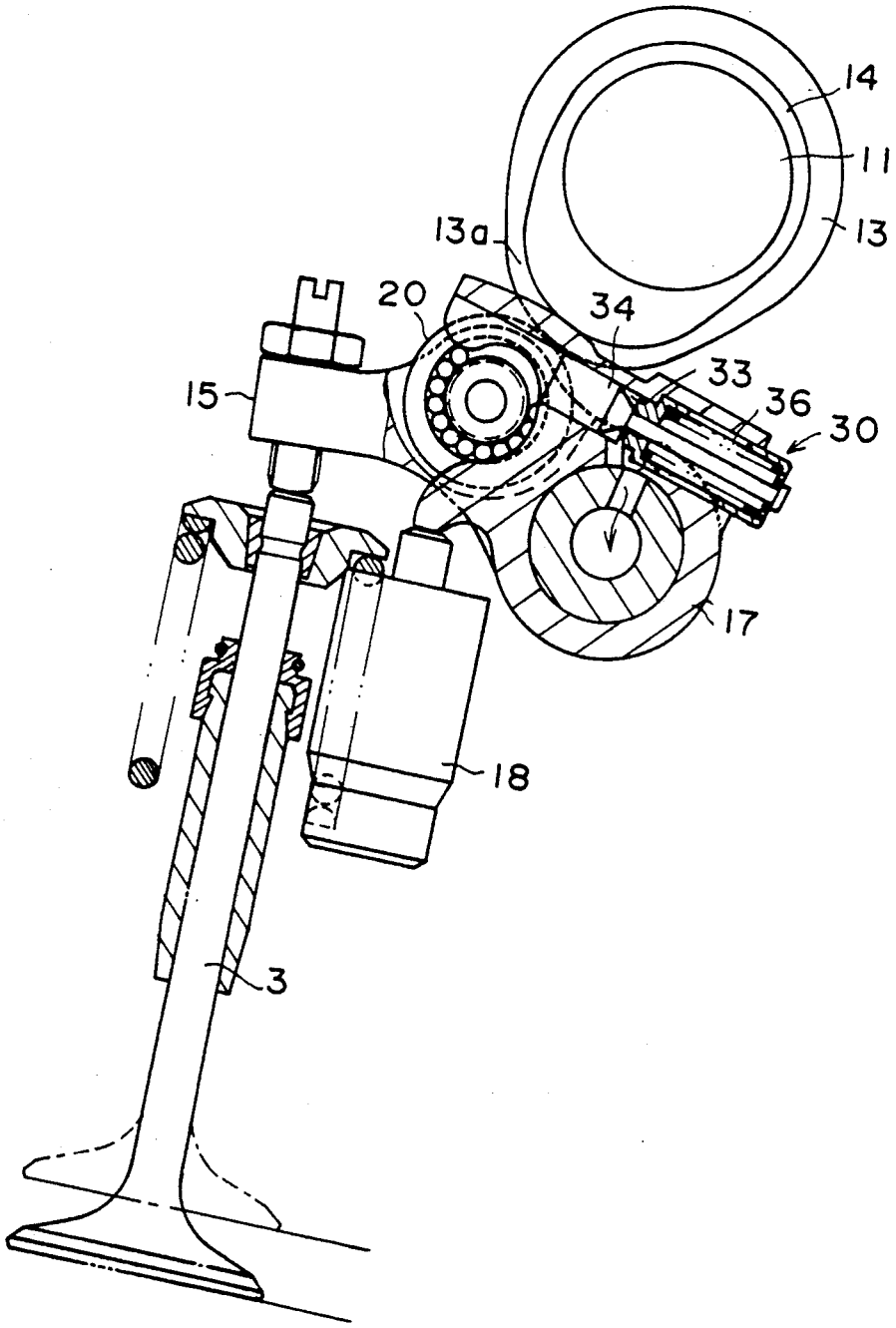
FIGS. 6*a* and 6*b* are sectional views explaining the operation of the valve mechanism in a low engine speed range and in a high engine speed range, respectively.

The operation of valve mechanism is described hereinafter with reference to FIGS. 6*a*, 6*b* and 7.

When it is determined at the engine speed range determining section 51 that the engine speed Ne is smaller than the reference speed NI in accordance with the engine speed Ne and the throttle opening degree $\theta$, the changeover valve 45 operates to drain the oil chamber 33 in each of the changeover devices 30. Thus, the spring 36 urges the piston 34 to be retracted inside the rocker arm 17 as shown in FIG. 6*a*. Thus, the low-speed rocker arms 15, 15' and the high-speed rocker arm 17 are disconnected from each other. Hence the low-speed rocker arms 15, 15' bear on the low-speed cams 13, 13', so that each valve 3, 3' opens at a small lift and small valve opening degree as shown by a line lL in FIG. 7, thereby providing a stable combustion and hence a stable engine torque. Since the roller followers 20, 20' contact with the cams 13, 13', the friction therebetween is small. Meanwhile the high-speed rocker arm 17 urged by the spring means 18 to the high-speed cam 14 is idly rocked.

When the high-speed rocker arm 17 bears on the base circle 14*b* of the cam 14, the low speed rocker arms 15, 15' also abut on the base circles 13*b* of the low-speed cams 13, 13'. Consequently, the rocker arms 15, 15' and 17 are positioned at upper positions to form a large space between the rocker arm shaft 21 and the rocker arm 17. Thus, it is possible for the piston 34 of the changeover device 30 to be projected into the space.

When it is determined at the engine speed range determining section 51 of the control unit 50 that the engine speed is in the high engine speed range ($Ne \geqq NI$), the changeover valve 45 is operated to apply oil to the oil chamber 33 of each changeover device 30.

Figure 6B:
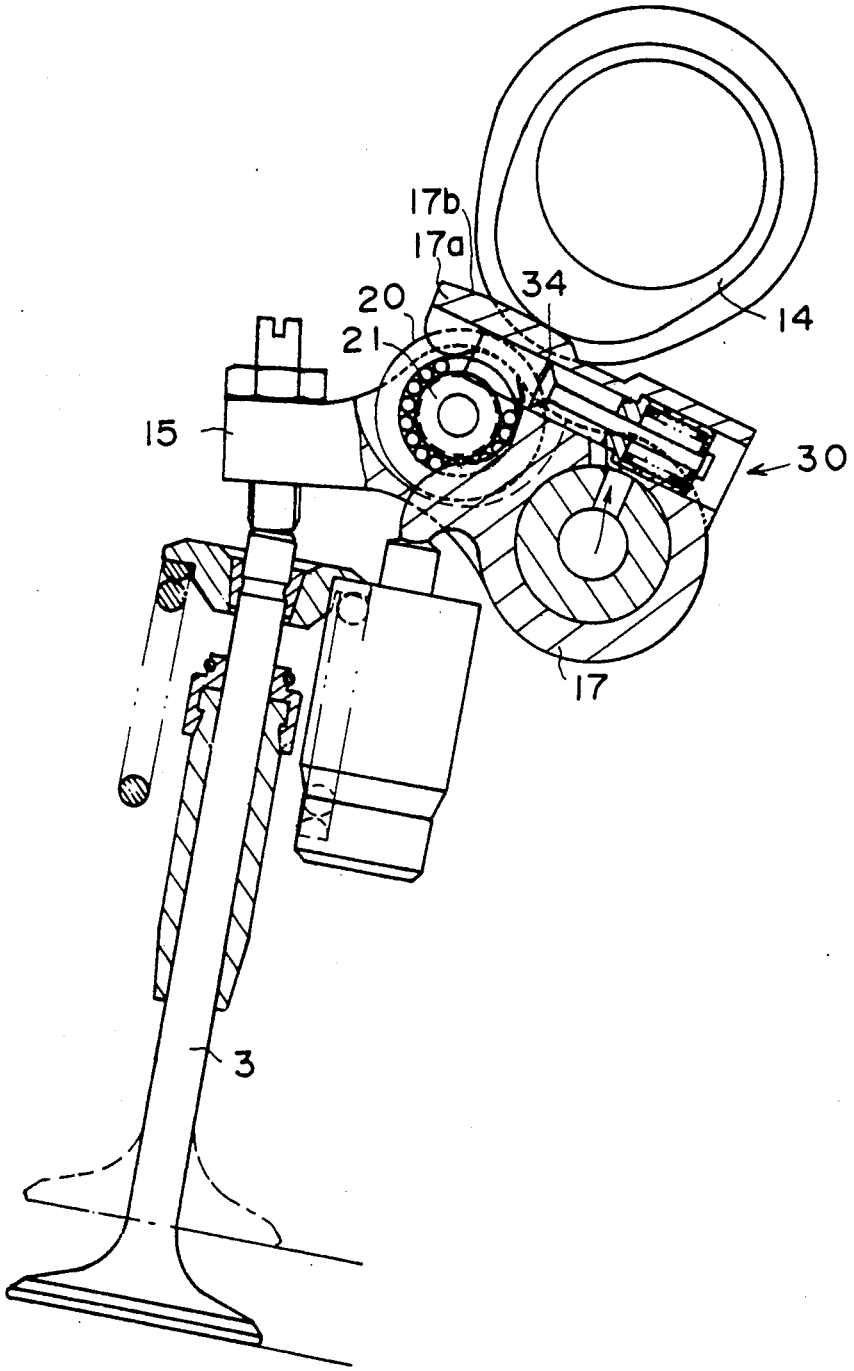
Figure 7:
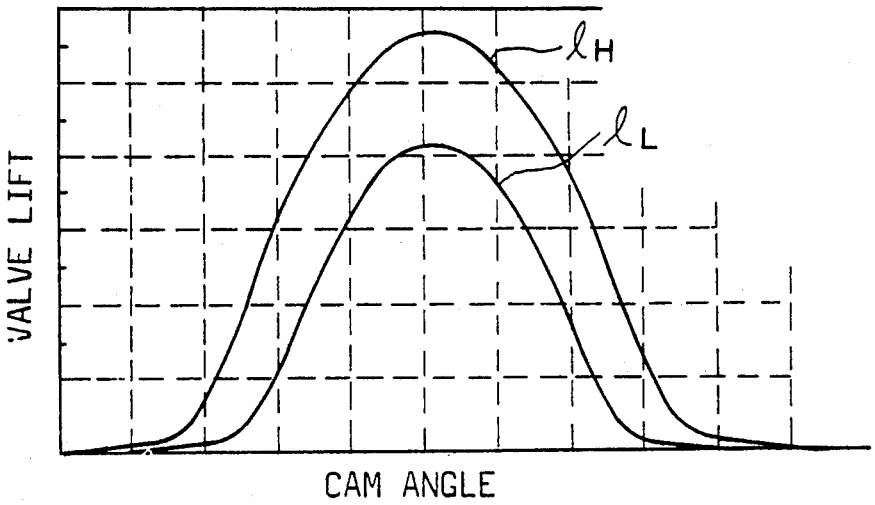
FIG. 7 is a graph showing the characteristics of the valve lift of the valves in accordance with the present invention.

The piston 34 is pushed by the pressure of oil in the chamber 33 and inserted between the upper end 17*a* of the rocker arm 17 and groove 37 of the shaft 21 as shown in FIG. 6*b* when the rocker arms bear on the base circles. Thus, the high-speed rocker arm 17 is connected with the low-speed rocker arm 15, 15' through the piston 34 and the shaft 21. When the rocker arm 17 bears on the lobe 14*a* of the high-speed cam 14, the roller follower 20, 20' do not engage with the lobes 13*a* of the low-speed cams 13, 13' as shown in FIG. 6*b*. Thus, the valves 3, 3' are opened at a large lift and a large opening degree as shown by a line lH in FIG. 7. The high-speed cam 14 engages the rocker arm 17 through the slipper 17*b*. However, since the cam is rotated at a high speed, the friction therebetween is reduced by a film of oil formed between the slipper 17*b* and the cam 14.

The operating condition of the changeover device 30 is changed in dependency on the throttle opening degree $\theta$ so that fuel consumption and acceleration characteristics are improved. At a cold engine determined in accordance with the coolant temperature Tw, the valves are opened as in the low engine speed range, so that engine speed becomes stable and the warm-up of the engine is enhanced.

Figure 8:
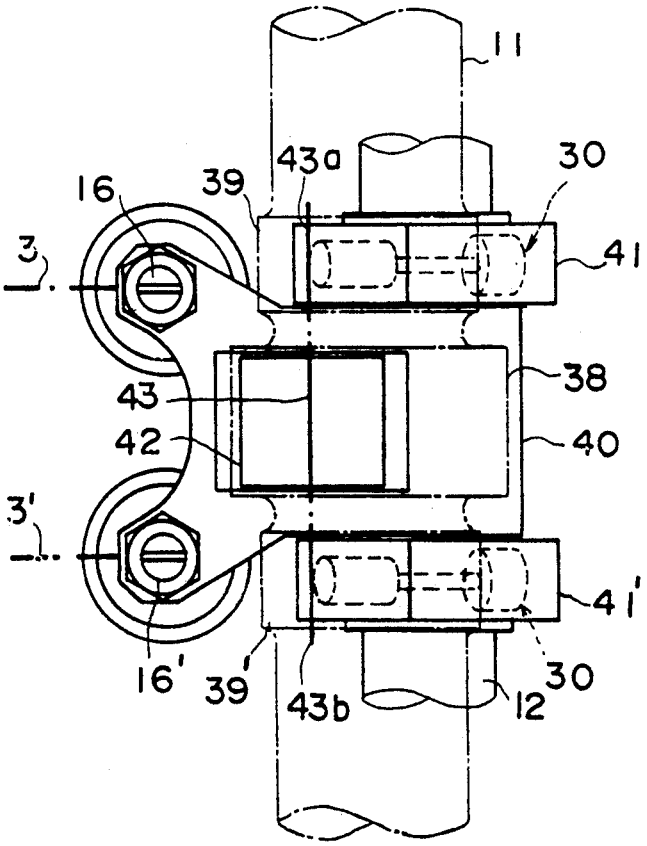
FIG. 8 is a plan view of a second embodiment of the valve mechanism of the present invention.

Referring to FIG. 8 showing the second embodiment of the present invention, a pair of high-speed cams 39, 39' and a low-speed cam 38 between the high-speed cams 39, 39' are formed on the cam shaft 11. A pair of high-speed rocker arms 41, 41' are pivotally mounted on the rocker arm shaft 12 at positions corresponding to the high-speed cams 39, 39' respectively. A bifurcated low-speed rocker arm 40 is pivotally mounted on the rocker arm shaft 12 between the high-speed rocker arms 41 and 41'. The bifurcated ends of the rocker arm 40 are connected to the stem ends 3*b* of the valves 3, 3' through the adjusting screws 16, 16'. A roller follower 42 which is rotatably mounted on a shaft 43 engages with the low-speed cam 38 in the manner as in the first embodiment. Both ends of the shaft 43 are projected below the high-speed rocker arms 41 and 41', respectively.

The changeover device 30 is provided in each of the high-speed rocker arms 41, 41'. The piston of the changeover device 30 is inserted in the space between an end portion 43*a* (43*b*) of the shaft 43 and the high-speed rocker arm 41 (41') so as to connect the high-speed rocker arms 41, and 41' with the low-speed rocker arm 40 when actuated. The other constructions and functions are the same as the first embodiment of the present invention.

The engine speed range can be determined in consideration to other factors besides throttle opening degree and coolant temperature. Furthermore, the present invention may be applied to a valve mechanism for the exhaust valves or to a valve mechanism for a single valve type engine having a single intake valve and a single exhaust valve.

Figure 9:
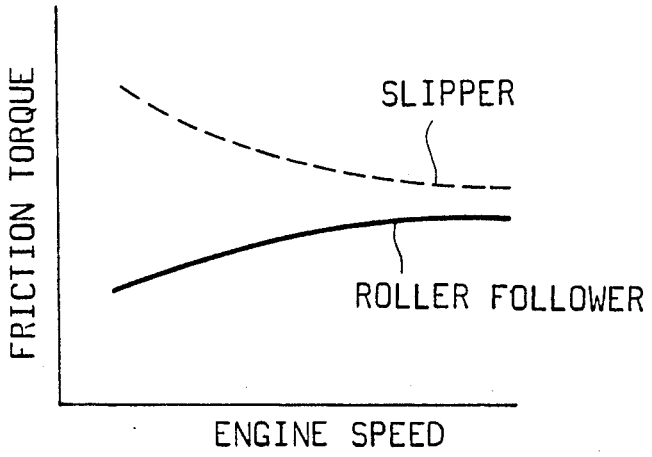
FIG. 9 is a graph showing relationships between friction torques of a slipper and a roller follower and engine speed.

In accordance with the present invention, the roller follower is provided between the cam and the rocker arm for the low engine speed range, thereby decreasing the torque necessary to drive the rocker arm, and hence improving fuel consumption. As shown in FIG. 9, the friction torque of the roller follower increases with the engine speed. However, since the slipper is provided between the cam and the rocker arm for the high engine speed range and the roller follower need be light, maximum torque of the roller follower can be reduced, thereby decreasing the size and the weight of the valve mechanism. A large part of the roller follower is disposed inside the rocker arm so that the height of the camshaft is not increased. The changeover device for selecting the set of cam and rocker arm comprises a piston which is inserted in a gap between the shaft of the roller follower and the slipper so that the construction is compact and the assemblage thereof is simplified despite the existence of the roller follower. Furthermore, since the device is hydraulically operated in accordance with the engine operating conditions, the selection of the rocker arm is accurately done. Since the base circles of the cams differ from each other, the cam followers can be designed at will. Moreover, since the base circle of the cam for the low engine speed range has a large diameter, the cam can be smoothly contoured, thereby decreasing noises which occur when the valves strike the valve seats.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A valve mechanism for an internal combustion engine having at least one intake valve and at least one exhaust valve, a cam shaft having a low-speed cam and a high-speed cam, a low-speed rocker arm operatively connected to said at least one of said valves and a high-speed rocker arm which are rocked by the cams to operate the at least one valve, changeover means for connecting the low-speed rocker arm and the high-speed rocker arm with each other so as to be rocked together by the high-speed cam, an improvement of the mechanism comprises:

a base circle of said low-speed cam having a larger diameter than that of the base circle of the high-speed cam;

a roller follower rotatably mounted on a shaft provided in the low-speed rocker arm, a part of a peripheral portion of the roller follower being projected from the low-speed rocker arm to be engaged with the low-speed cam;

said high-speed rocker arm having a slipper engaging with the high-speed cam; and said changeover means comprising a piston slidably mounted in said high-speed rocker arm and means for pushing the piston so as to connect the high-speed rocker arm with the low-speed rocker arm.

2. The valve mechanism according to claim 1, wherein said piston is disposed perpendicular to the axis of said shaft for the roller follower.

3. The valve mechanism according to claim 2, wherein two sets of low-speed cams and low-speed rocker arms are provided for operating two valves, respectively, and said high-speed rocker arm is disposed between the low-speed rocker arms, said piston of said changeover means is so provided as to engage with a common shaft for the respective two roller followers.

4. The valve mechanism according to claim 2, wherein two sets of the high-speed rocker arms are provided, the low-speed rocker arm is disposed between the high-speed rocker arms and shaped to operate two valves.

* * * * *